US012305859B2

(12) United States Patent
Kim et al.

(10) Patent No.: US 12,305,859 B2
(45) Date of Patent: May 20, 2025

(54) NOZZLE ASSEMBLY, COMBUSTOR, AND GAS TURBINE INCLUDING SAME

(71) Applicant: DOOSAN ENERBILITY CO., LTD., Changwon (KR)

(72) Inventors: Hokeun Kim, Daejeon (KR); Hanjin Jeong, Hanam (KR); Taewon Bae, Gimhae (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/477,565

(22) Filed: Sep. 29, 2023

(65) Prior Publication Data

US 2024/0175581 A1 May 30, 2024

(30) Foreign Application Priority Data

Nov. 30, 2022 (KR) ..... 10-2022-0164595

(51) Int. Cl.
*F23R 3/28* (2006.01)
*F23R 3/04* (2006.01)

(52) U.S. Cl.
CPC ..... *F23R 3/283* (2013.01); *F23R 3/04* (2013.01)

(58) Field of Classification Search
CPC .. F23R 3/283; F23R 3/16; F23R 3/045; F23R 3/04; F23R 3/286; F23D 3/22
See application file for complete search history.

(56) References Cited

U.S. PATENT DOCUMENTS 8,438,851 B1 5/2013 Uhm
2014/0053571 A1* 2/2014 Keener ..... F23R 3/283 60/782

(Continued)

FOREIGN PATENT DOCUMENTS

JP 1994-055050 U 7/1994
JP 2010-091258 A 4/2010

(Continued)

OTHER PUBLICATIONS dictionary.com; https://web.archive.org/web/20220204184554/https://www.dictionary.com/browse/end; 2022.*

(Continued)

*Primary Examiner* — Devon C Kramer
*Assistant Examiner* — Rodolphe Andre Chabreyrie
(74) *Attorney, Agent, or Firm* — Harvest IP Law, LLP

(57) ABSTRACT

Proposed are a nozzle assembly, a combustor, and a gas turbine. Fuel and compressed air are discharged to a combustion chamber of the combustor of the gas turbine. The nozzle assembly includes a nozzle body, a plurality of injection nozzles provided inside the nozzle body and disposed to be spaced apart from each other, the injection nozzles having inner portions through which the compressed air and the fuel are mixed and moved, and a side wall which is connected to a first side of the nozzle body and through which the injection nozzles passes. A cooling air inlet hole into which cooling air is introduced into a space where the injection nozzles are disposed is formed in the nozzle body, and a cooling air outlet hole through which the cooling air introduced from the cooling air inlet hole is discharged is formed in one region of the side wall.

19 Claims, 6 Drawing Sheets

(56) References Cited

U.S. PATENT DOCUMENTS

| | | | | |
|---|---|---|---|---|
| 2017/0268780 | A1* | 9/2017 | Purcell | F23R 3/283 |
| 2018/0031239 | A1* | 2/2018 | Frost | F23R 3/46 |
| 2018/0106482 | A1* | 4/2018 | Berry | F23R 3/286 |
| 2020/0158343 | A1 | 5/2020 | Boardman | |
| 2022/0228741 | A1 | 7/2022 | Jeong | |

FOREIGN PATENT DOCUMENTS

| | | | |
|---|---|---|---|
| JP | 2012-092832 | A | 5/2012 |
| JP | 2015-017715 | A | 1/2015 |
| JP | 2020-016369 | A | 1/2020 |
| KR | 10-2022-0104492 | A | 7/2022 |

OTHER PUBLICATIONS

Definition “End”.*

* cited by examiner

NOZZLE ASSEMBLY, COMBUSTOR, AND GAS TURBINE INCLUDING SAME

CROSS REFERENCE TO RELATED APPLICATION

The present application claims priority to Korean Patent Application No. 10-2022-0164595, filed on Nov. 30, 2022, the entire contents of which are incorporated herein for all purposes by this reference.

BACKGROUND OF THE INVENTION

1. Field of the Invention

Embodiments of the present disclosure relate to a nozzle assembly, a combustor, and a gas turbine including the same. More particularly, embodiments of the present disclosure relate to a nozzle assembly, a combustor, and a gas turbine including the nozzle assembly and the combustor, the nozzle assembly having a nozzle tip cooling structure.

2. Description of the Background Art

A turbo machine refers to an apparatus that generates a driving force used to generate electric power by using fluid (e.g., gas) passing through the turbo machine. Therefore, such a turbo machine is usually installed and used together with a generator. A gas turbine, a steam turbine, a wind power turbine, and so on may correspond to the turbo machine. The gas turbine is an apparatus that generates combustion gas by mixing compressed air and natural gas and by combusting the mixture, and generates a driving force for generation of electric power by using the combustion gas. The steam turbine is an apparatus that heats water to generate steam and generates a driving force for generation of electric power by using the steam. A wind turbine is an apparatus that converts wind power into a driving force for generation of electric power.

In such a turbo machine, the gas turbine includes a compressor, a combustor, and a turbine. The compressor includes a plurality of compressor vanes and a plurality of compressor blades which are alternately provided in a compressor casing. In addition, the compressor is configured to intake external air through a compressor inlet scroll strut. The intaken air is compressed by the compressor vanes and the compressor blades while passing through an inner portion of the compressor. The combustor receives compressed air compressed in the compressor, and mixes the compressed air with fuel. In addition, the combustor ignites fuel mixed with compressed air by using an igniter, thereby generating high-temperature and high-pressure combustion gas. Such generated combustion gas is supplied to the turbine. The turbine includes a plurality of turbine vanes and a plurality of turbine blades which are alternately provided in a turbine casing. In addition, the turbine receives combustion gas generated at the combustor, and passes the combustion gas through an inner portion of the turbine. Combustion gas passing through the inner portion of the turbine rotates the turbine blades, and the combustion gas that has completely passed through the inner portion of the turbine is discharged to an outside of the turbine through a turbine diffuser.

In such a turbo machine, the gas turbine may use hydrogen as fuel. Such a hydrogen gas turbine uses a micromixer or a multi-tube combustor for combusting hydrogen.

When combustion using such a micromixer or a multi-tube combustor is performed, hydrogen is added into the fuel or only hydrogen fuel is combusted so as to reduce carbon emissions. Although this combustion technology prevents flashback with hydrogen fuel, there is an issue of potential flame flashback when a temperature of an outlet end rises. This occurs because flame flashback is sensitive not only to the speed at which the fuel/air mixture is supplied but also to a wall surface temperature of the nozzle through which it is supplied.

SUMMARY OF THE INVENTION

Accordingly, the present disclosure has been made keeping in mind the above problems occurring in the related art, and an objective of the present disclosure is to provide a nozzle assembly, a combustor, a gas turbine configured such that cooling air is supplied between injection nozzles, thereby preventing flame flashback from occurring.

The technical problems that are intended to be addressed in the present disclosure are not restricted to the above described problems, and other problems, which are not mentioned herein, could be clearly understood by those of ordinary skill in the art from details described below.

According to an embodiment of the present disclosure, there is provided a nozzle assembly configured to discharge fuel and compressed air into a combustion chamber of a combustor of a gas turbine, the nozzle assembly including: a nozzle body; a plurality of injection nozzles provided inside the nozzle body and disposed to be spaced apart from each other, the plurality of injection nozzles having inner portions through which the fuel and a first portion of the compressed air are mixed and flow; and a side wall which is connected to a first side of the nozzle body and through which the plurality of injection nozzles passes, wherein a cooling air inlet hole into which a second portion of the compressed air is introduced, as a cooling air, into a space where the plurality of injection nozzles is disposed is formed in the nozzle body, and a cooling air outlet hole through which the cooling air introduced from the cooling air inlet hole is discharged is formed in one region of the side wall.

Preferably, the side wall may be provided with a guide portion that protrudes inside the nozzle body, and first sides of the injection nozzles may be inserted into the guide portion.

Preferably, the guide portion may be disposed such that the guide portion has a region that is spaced apart from outer surfaces of the injection nozzles.

Preferably, the cooling air outlet hole may be formed in one region of the guide portion.

Preferably, the guide portion may be disposed such that one region of the guide portion is in contact with the injection nozzles.

Preferably, an inner end portion of the guide portion may have elasticity.

Preferably, the cooling air outlet hole may include a plurality of cooling air outlet holes, and the plurality of cooling air outlet holes may be formed in the inner end portion of the guide portion along a longitudinal direction of the guide portion.

Preferably, a cross-section of the guide portion may have a shape that is same as a cross-section of the injection nozzles.

In addition, according to the present disclosure, there is provided a combustor configured to mix compressed air supplied from a compressor of a gas turbine with fuel and to combust a mixture of the compressed air and the fuel, the combustor being configured to supply a generated combustion gas to a turbine of the gas turbine, and the combustor including: a nozzle casing; a liner connected to an end portion of the nozzle casing, the liner having an inner portion provided with a combustion chamber in which the mixture of the compressed air and the fuel is combusted; a transition piece connected to an end portion of the liner, the transition piece being configured to supply the combustion gas generated from the combustion chamber to the turbine; and a nozzle assembly mounted inside the nozzle casing and configured to discharge the fuel and the compressed air into the combustion chamber, wherein the nozzle assembly includes: a nozzle body; a plurality of injection nozzles provided inside the nozzle body and disposed to be spaced apart from each other, the plurality of injection nozzles having inner portions through which the fuel and a first portion of the compressed air are mixed and flow; and a side wall which is connected to a first side of the nozzle body and through which the plurality of injection nozzles passes, wherein a cooling air inlet hole into which a second portion of the compressed air is introduced, as a cooling air, into a space where the plurality of injection nozzles is disposed is formed in the nozzle body, and a cooling air outlet hole through which the cooling air introduced from the cooling air inlet hole is discharged is formed in one region of the side wall.

In addition, according to the present disclosure, there is provided a gas turbine including: a compressor configured to compress air introduced from outside; a combustor configured to mix compressed air supplied from the compressor with fuel and to combust a mixture of the compressed air and the fuel; and a turbine configured to generate power for generating electric power by passing combustion gas supplied from the combustor to an inner portion of the turbine, wherein the combustor includes: a nozzle casing; a liner connected to an end portion of the nozzle casing, the liner having an inner portion provided with a combustion chamber in which the mixture of the compressed air and the fuel is combusted; a transition piece connected to an end portion of the liner, the transition piece being configured to supply the combustion gas generated from the combustion chamber to the turbine; and a nozzle assembly mounted inside the nozzle casing and configured to discharge the fuel and the compressed air into the combustion chamber, wherein the nozzle assembly includes: a nozzle body; a plurality of injection nozzles provided inside the nozzle body and disposed to be spaced apart from each other, the plurality of injection nozzles having inner portions through which a first portion of the compressed air are mixed and flow; and a side wall which is connected to a first side of the nozzle body and through which the plurality of injection nozzles passes, wherein a cooling air inlet hole into which a second portion of the compressed air is introduced, as a cooling air, into a space where the plurality of injection nozzles is disposed is formed in the nozzle body, and a cooling air outlet hole through which the cooling air introduced from the cooling air inlet hole is discharged is formed in one region of the side wall.

According to an embodiment, there is an effect that flame flashback is prevented by cooling tip portions of the plurality of injection nozzles of the combustor.

In addition, assembly of the plurality of injection nozzles may be facilitated.

Various and beneficial advantages and effects of the present disclosure are not limited to the above, and will be more easily understood in the course of describing specific embodiments of the present disclosure.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
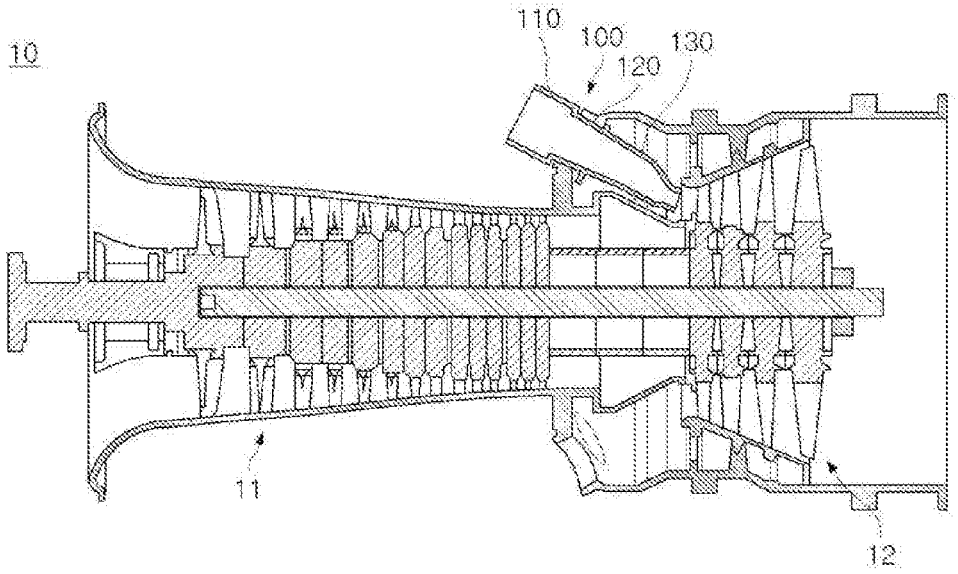
FIG. 1 is a cross-sectional view illustrating a gas turbine according to the present disclosure.
Figure 2:
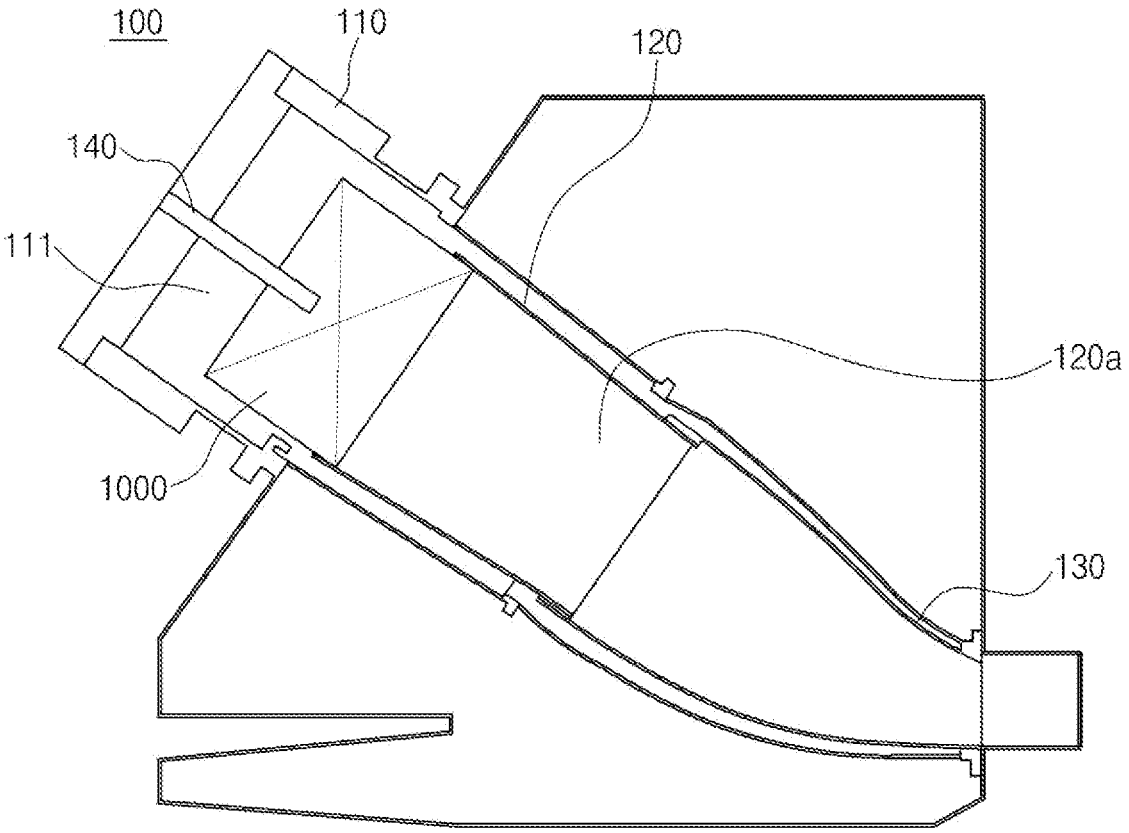
FIG. 2 is a view schematically illustrating a combustor illustrated in FIG. 1.
Figure 3:
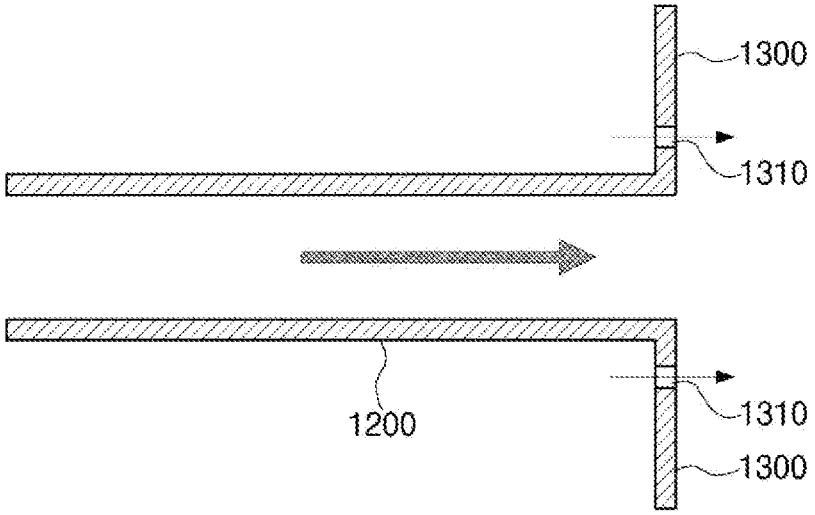
FIG. 3 is a view illustrating a first embodiment of a nozzle assembly illustrated in FIG. 1.

Hereinafter, exemplary embodiments of the present disclosure will be described in detail with reference to the accompanying drawings.

However, the technical spirit of the present disclosure is not limited to some of the described embodiments, but may be implemented in various different forms, and as long as it is within the scope of the technical spirit of the present disclosure, one or more of the elements may be selectively combined and substituted between the embodiments.

In addition, terms (including technical and scientific terms) used in the embodiments of the present disclosure may be generally understood by those of ordinary skilled in the art to which the present disclosure belongs, unless specifically defined and described explicitly, and terms commonly used, such as terms defined in the dictionary, may be interpreted in consideration of the contextual meaning of the related art.

In addition, the terms used in the embodiments of the present disclosure are for describing the embodiments, and are not intended to limit the present disclosure.

In this specification, a singular form may also include a plural form unless otherwise specifically indicated, and when it is described as 'at least one (or one or more) of A and (with) B, C', it may include one or more of all possible combinations of A, B, and C.

In addition, in describing the components of the embodiment of the present disclosure, terms such as first, second, A, B, (a), (b), and so on may be used. These terms are only for distinguishing the component from other components, and are not limited to the essence, order, or sequence of the component by the terms.

In addition, when one component is referred to as being 'connected', 'coupled', or 'contacted' to another component, it should be understood that the component may be directly connected, coupled, or contacted to the other component or may be 'connected', 'coupled', or 'contacted' to the other component via another component therebetween.

In addition, when one component is referred to as being formed or disposed on 'upper (above) or lower (below)' of each component, the upper (above) or lower (below) includes not only the case where two components are in direct contact with each other, but also a case where one or more other components are formed or disposed between the two components. In addition, when expressed as 'upper (above) or lower (below)', the meaning of not only the upper direction but also the lower direction based on one component may be included.

Hereinafter, embodiments of the present disclosure will be described in detail with reference to the accompanying drawings, and in the description with reference to the accompanying drawings, the same or corresponding components may be given the same reference numbers, and an overlapped description therewith will be omitted.

FIGS. 1 to 6 are intended to provide conceptual and clear understanding of the main features of the present disclosure. As a result, various modifications of the drawings are expected, and the scope of the present disclosure should not be limited to particular shapes depicted in the drawings.

Referring to FIG. 1, a gas turbine 10 of the present disclosure includes a compressor 11, a combustor 100, and a turbine 12.

On the basis of a flow direction of gas (compressed air or combustion gas), the compressor 11 is disposed at an upstream side of the gas turbine 10, the turbine 12 is disposed at a downstream side of the gas turbine 10, and the combustor 100 is disposed between the compressor 11 and the turbine 12.

The compressor 11 accommodates compressor vanes and compressor rotors in a compressor casing, and the turbine 12 accommodates turbine vanes and turbine rotors in a turbine casing. The compressor vanes and the compressor rotors are disposed in a multi-stage structure along the flow direction of compressed air, and the turbine vanes and the turbine rotors are also disposed in a multi-stage structure along the flow direction of combustion gas.

Here, the compressor 11 is designed such that an internal space thereof is gradually decreased in size from a front stage to a rear stage so that air intaken into the compressor 11 can be compressed. In contrast, the turbine 12 is designed such that an internal space thereof is gradually increased in size from a front stage to a rear stage so that combustion gas supplied from the combustor 100 can expand.

Meanwhile, a torque tube is disposed between the compressor rotor that is positioned at the rearmost stage of the compressor 11 and the turbine rotor that is positioned at the foremost stage of the turbine 12 and functions as a torque transmission member for transmitting rotational torque generated from the turbine 12 to the compressor 11.

As illustrated in FIG. 1, the torque tube may include a plurality of torque tube disks arranged in a multiple-stage structure, e.g., three-stage structure, but this is only one of various embodiments of the present disclosure. Furthermore, the torque tube may include a plurality of torque tube disks arranged in a structure of equal to or more than four stages or a structure of equal to or less than two stages.

Each compressor rotor includes a compressor disk and compressor blades. In the compressor casing, a plurality (e.g., fourteen) of compressor disks is provided, and each of the compressor disks is coupled to a tie rod such that the compressor disks are not spaced apart from each other in an axial direction.

In more detail, with the tie rod passing through each center portion of the compressor disks, each of the compressor disks is arranged along the axial direction. In addition, the compressor disks adjacent to each other are disposed such that facing surfaces of adjacent compressor disks are pressed by the tie rod so that the adjacent compressor disks cannot independently rotate.

A plurality of compressor blades is radially coupled to an outer circumferential surface of each of the compressor disks.

In addition, a plurality of compressor vanes which is mounted on an inner circumferential surface of the compressor casing and which is formed in an annular shape is disposed between the compressor blades on the basis of respective stages.

Unlike the compressor disks, the compressor vanes are in a fixed state such that the compressor vanes do not rotate. Furthermore, the compressor vanes are configured to align a flow of compressed air that has passed through the compressor blades which are positioned at the upstream side, and are configured to guide the compressed air to the compressor blades which are positioned at the downstream side.

Here, in order to distinguish the compressor casing and the compressor vanes from the compressor rotors, the compressor casing and the compressor vanes may be collectively referred to as a compressor stator.

The tie rod is disposed such that the tie rod passes through center portions of the plurality of compressor disks and center portions of the turbine disks that will be described later. Furthermore, a first side end portion of the tie rod is fastened to an inside of the compressor disk that is positioned at the foremost side of the compressor 11, and a second side end portion of the tie rod is fastened by a fixing nut.

A shape of the tie rod is not limited to the shape illustrated in FIG. 1, and the tie rod may be formed in various structures according to the gas turbine. That is, it is possible to have a design where a single tie rod passes through the center portions of both the compressor disks and the turbine disks. Alternatively, it is also possible to have multiple tie rods arranged in a circumferential direction, or a combination of the these two approaches.

Although not illustrated, a deswirler may be mounted in the compressor 11 of the gas turbine 10 and functions as a guide vane. The deswirler may be configured to increase a pressure of fluid flowing into an inlet of the combustor 100 and is configured to adjust a flow angle of the fluid to a designed flow angle.

The combustor 100 mixes introduced compressed air with fuel and combusts the fuel mixture to generate high-temperature and high-pressure combustion gas having high energy. The temperature of the combustion gas is increased through an isobaric combustion process to a heat-resistant temperature limit that components of the combustor 100 and the turbine 12 can endure.

The combustor 100 constituting a combustion system of the gas turbine 10 may include a plurality of combustors 100 arranged in a combustor casing formed in a cell shape. Each of the combustors 100 includes a nozzle assembly 1000 for ejecting fuel, a liner 120 forming a combustion chamber 120*a*, and a transition piece 130 serving as a connection portion between the combustor 100 and the turbine 12.

Specifically, the liner 120 provides a combustion space in which fuel ejected from the nozzle assembly 1000 is mixed with compressed air from the compressor 11 and then combusted. Surrounded by the liner 120, the combustion chamber 120*a* is formed and provides the combustion space in which the fuel mixed with air is combusted. In the liner 120, a liner annular channel is formed between an inner wall and an outer wall, having a shape of an annular space surrounding the combustion chamber 120*a*.

In addition, the nozzle assembly 1000 for ejecting fuel is coupled to a front end of the liner 120, and an igniter is coupled to a side wall of the liner 120.

Compressed air introduced through a plurality of holes formed in the outer wall of the liner 120 flows in the liner annular channel. Furthermore, compressed air used to cool the transition piece 130 that will be described later also flows through the liner annular channel.

As such, since compressed air flows along the inner and outer wall portions of the liner 120, the liner 120 may be protected from thermal damages caused by heat generated during fuel combustion in the combustion chamber 120*a*.

The transition piece 130 is connected to a rear end of the liner 120 to facilitate the transfer of combustion gas, ignited by an ignition plug, toward the turbine 12.

Similar to the liner 120, the transition piece 130 has a transition piece annular channel surrounding an internal space of the transition piece 130. The transition piece annular channel is formed between an inner wall and outer wall of the transition piece 130. Furthermore, the inner and outer walls of the transition piece 130 are cooled by compressed air flowing along the transition piece annular channel so that the transition piece 130 is protected from thermal damages caused by high-temperature of the combustion gas.

Meanwhile, the high-temperature and high-pressure combustion gas discharged from the combustor 100 is supplied into the turbine 12 that is described above. High-temperature and high-pressure combustion gas supplied into the turbine 12 expands while passing through an inner portion of the turbine 12, thereby applying impulsive force and reaction force to turbine blades so that rotational torque is generated. The rotational torque obtained in this manner is transmitted to the compressor 11 via the torque tube described above, and an additional rotation torque in excess of the torque required to drive the compressor 11 is used to drive a generator and so on.

The turbine 12 basically has a structure similar to that of the compressor 11. That is, the turbine 12 is also provided with a plurality of turbine rotors similar to the compressor rotors of the compressor 11. Therefore, each turbine rotor 14 also includes a turbine disk and a plurality of turbine blades radially disposed around the turbine disk.

A plurality of turbine vanes which is mounted in the turbine casing and which is disposed in an annular shape is provided between the turbine blades on the basis of respective stages. Furthermore, the turbine vanes guide the flow direction of the combustion gas passing through the turbine blades. Here, in order to distinguish the turbine casing and the turbine vanes from the turbine rotor, the turbine casing and the turbine vanes may be collectively referred to as a turbine stator.

In addition, the combustor 100 that is a component of the gas turbine 10 according to an embodiment of the present disclosure may include a nozzle casing 110, the liner 120, the transition piece 130, a fuel supply pipe 140, and the nozzle assembly 1000.

The nozzle casing 110 is supplied with compressed air from the compressor 11, and the compressed air is mixed with fuel in the nozzle assembly 1000 and then supplied to the combustion chamber 120*a*.

The liner 120 is connected to a downstream side of the nozzle casing 110 on the basis of the flow direction of compressed air or combustion gas, and the combustion chamber 120*a* is formed inside the liner 120. The mixed fluid (generated by mixing compressed air with fuel), ejected from the nozzle assembly 1000, is combusted in the combustion chamber 120*a*.

The transition piece 130 is connected to a downstream side of the liner 120. The transition piece 130 is configured to supply the combustion gas generated in the combustion chamber 120*a* of the liner 120 to the turbine 12.

In addition, the fuel supply pipe 140 is provided at an inner center of the nozzle casing 110, and is configured to guide the fuel supplied from the outside to be moved inside the nozzle casing 110. At this time, the supplied fuel may be hydrogen, but is not limited thereto.

In addition, the nozzle assembly 1000 is connected to a first side of the fuel supply pipe 140. In the nozzle assembly 1000, compressed air introduced through the nozzle casing 110 and fuel introduced through the fuel supply pipe 140 are mixed with each other in a plurality of injection nozzles 1200, and then are discharged as a mixed fluid into the combustion chamber 120*a*.

Referring to FIGS. 3 to 6, the nozzle assembly 1000 may include a nozzle body 1100, the injection nozzles 1200, and a side wall 1300. The injection nozzles 1200 are formed elongated toward the combustion chamber 120*a* and are perpendicular to the combustion chamber 120*a*. The side wall 1300 is formed at the downstream end of the injection nozzles 1200 and defines the upstream end of combustion chamber 120*a* based on the flow direction of the air-fuel mixture in the injection nozzles 1200. Thus, the side wall 1300 is formed perpendicular to the direction in which the injection nozzles 1200 is elongated. The direction in which the injection nozzles 1200 is elongated may be referred to as an axial direction or longitudinal direction. Throughout the specification, in the axial direction, the downstream direction and downstream end means the axial direction toward the combustion, and the upstream direction and the upstream end are the opposite direction to the downstream direction and downstream end.

The nozzle body 1100 provides a disposition space (may be referred to as a cooling air plenum) in which the plurality of injection nozzles 1200 are positioned, and provides a space through which compressed air is moved therein. There is no limitation in a shape of the nozzle body 1100, and various structures for fixing the injection nozzles 1200 may be provided.

As an embodiment, the nozzle body 1100 may be provided in a cylindrical structure. A cooling air inlet hole 1110 may be formed in the nozzle body 1100. This cooling air inlet hole 1110 allows cooling air to be drawn into a space where the injection nozzles 1200 are located.

The cooling air inlet hole 1110 refers to a passage through which compressed air, introduced from the liner 120, can flow. A portion of the compressed air, introduced from the liner 120, flows to and in the injection nozzles 1200, and a second portion (e.g., the remaining portion) of the compressed air may flow through the cooling air inlet hole 1110. At this time, the compressed air flowing through the cooling air inlet hole 1110 functions as cooling air by cooling tips of the injection nozzles 1200. The compressed air flowing through the cooling air inlet hole 1110 is not introduced into the injection nozzles 1200 before it is discharged into the combustion chamber 120*a* and meets the fuel only after it is discharged into the combustion chamber 120*a*.

The plurality of injection nozzles 1200 is provided inside the nozzle body 1100 and is disposed to be spaced apart from each other. Inside the plurality of injection nozzles 1200, the compressed air and fuel may be mixed with each other and flows.

As an embodiment, the injection nozzle 1200 may have a cylindrical structure. However, the plurality of injection nozzles 1200 may have various structures.

The side wall 1300 is connected to a first side (i.e., downstream end) of the nozzle body 1100, and may be disposed such that the injection nozzles 1200 penetrate the side wall 1300. At this time, a cooling air outlet hole 1310, through which the cooling air introduced from the cooling air inlet hole 1110 is discharged, may be formed in a region of the side wall 1300.

In order to cool tip areas of the injection nozzles 1200, the cooling air outlet hole 1310 may form a flow of cooling air along the outer surface of the injection nozzles 1200. It is preferable that the cooling air outlet hole 1310 is formed adjacent to the injection nozzles 1200 that is fixed to the side wall 1300. The cooling air outlet hole 1310 may be formed to be concentric with and encircle (i.e., surround) the outlet of the injection nozzle 1200.

As an embodiment, when injection nozzles 1200 has a cylindrical shape, a plurality of cooling air outlet holes 1310 may be disposed in a region where the outer periphery portions of the injection nozzles 1200 and the side wall 1300 are connected to each other, and may be disposed in a circumferential direction at downstream end portions of the injection nozzles 1200.

However, there is no limitation in a shape of the cooling air outlet hole 1310. The shape of the cooling air outlet hole 1310 may be modified to various shapes such as a circular shape, a polygonal shape, a slit structure, and so on.

According to an embodiment, the side wall 1300 may be provided with a guide portion 1320 that protrudes from the side wall 1300 toward the upstream direction inside the nozzle body 1100, and a first side of the injection nozzle 1200 may be inserted into the guide portion 1320.

The guide portion 1320 has a structure in which the first side of the injection nozzle 1200 is inserted thereinto, and has a structure that protrudes inside the nozzle body 1100. Furthermore, the cooling air outlet hole 1310 may be formed in a region of the guide portion 1320.

The guide portion 1320 may be generally in a cylindrical shape elongated in the axial direction while encircling the injection nozzle 1200 and having a same axis with the injection nozzle 1200.

The guide portion 1320 is disposed such that certain region of the guide portion 1320 is in contact with the injection nozzle 1200 to stably support the injection nozzle 1200 and facilitate connection between the side wall 1300 and the injection nozzle 1200.

In addition, the guide portion 1320 may have a region that is spaced apart from an outer surface of the injection nozzle 1200. At this time, the cooling air outlet hole 1310 may be formed in a region inside a portion of the guide portion 1320 that protrudes radially inward, toward the central axis of the injection nozzle 1200.

The region where the guide portion 1320 and the injection nozzle 1200 are spaced apart from each other is functioning as a cooling air moving passage in which cooling air is capable of moving directly along the outer surface of the injection nozzle 1200.

That is, one region of the guide portion 1320 may be in contact with the injection nozzle 1200 and may serve to fixedly support the injection nozzle 1200, and a remaining region of the guide portion 1320 may serve to provide a passage through which the cooling air moves through the cooling air outlet hole 1310.

According to an embodiment, the injection nozzle 1200 and the side wall 1300 may be formed as separate structures and may be connected to each other by contact and support, or may be formed as an integrated structure by, for example, using a 3D printer.

Figure 4:
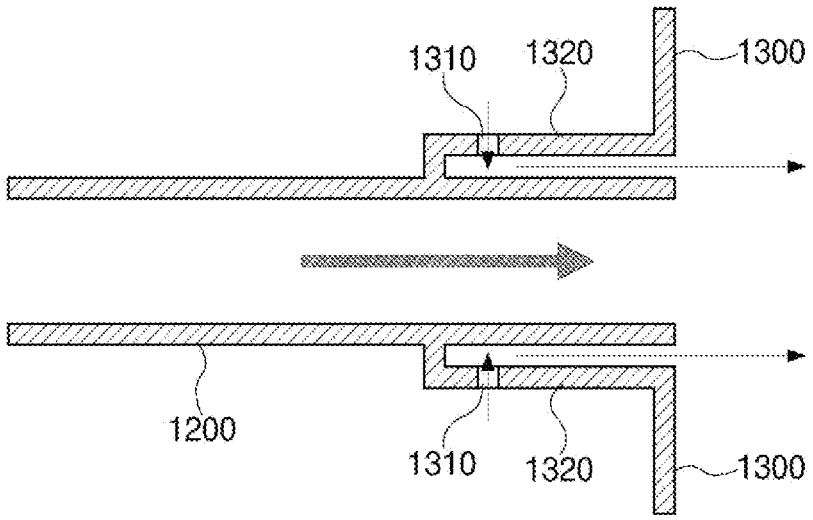
FIG. 4 is a view illustrating a second embodiment of the nozzle assembly illustrated in FIG. 1.

Referring to FIG. 4, the guide portion 1320 may be formed in a cylindrical shape having its inner diameter is constant from its upstream and to its downstream end. The cooling air outlet hole 1310 may be formed in its circumferential surface such that the cooling air is introduced in the radially inward direction toward a central axis of the injection nozzle 1200. The upstream end of the guide portion 1320 may be closed toward the upstream direction.

According to an embodiment, the region of the guide portion 1320 (the "contact region") which is in contact with the injection nozzle 1200 may have a cross-sectional shape same as a cross-sectional shape of the injection nozzle 1200, such that the injection nozzle 1200 is stably supported by such region of the guide portion 1320.

An inner end portion of the guide portion 1320 may have elasticity.

Unlike a case in which the injection nozzle 1200 and the side wall 1300 are integrally manufactured by using a 3D printer, when the side wall 1300 and the injection nozzle 1200 are separately manufactured, it is difficult to perform the coupling of the injection nozzle 1200 and the guide portion 1320. The end portion of the guide portion 1320 may solve such a problem by having elasticity. In in other words, the contact region of the guide portion 1320 may be configured to apply an elastic force in a radially inward direction of the injection nozzle 1200 such that the contact region of the guide portion 1320 support the injection nozzle 1200 by such elastic force.

Figure 6:
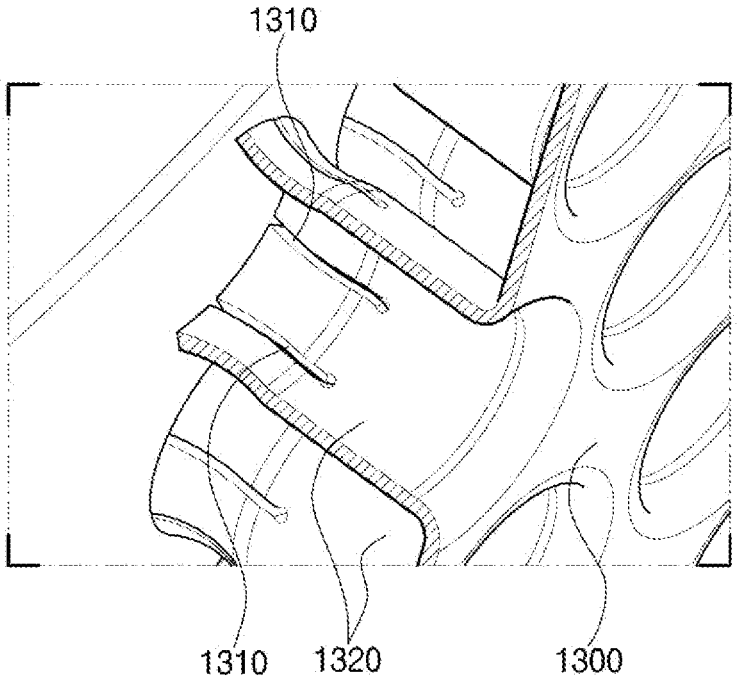
FIG. 6 is an enlarged view of the nozzle assembly illustrated in FIG. 5.

Furthermore, as shown in FIG. 6, the plurality of cooling air outlet holes 1310 may be formed in a shape of multiple slits along the longitudinal direction in the upstream end portion of the guide portion 1320. This design may facilitate the contact region of the guide portion 1320 to apply the inward-direction elastic force. The slits may be open toward the upstream direction.

Figure 5:
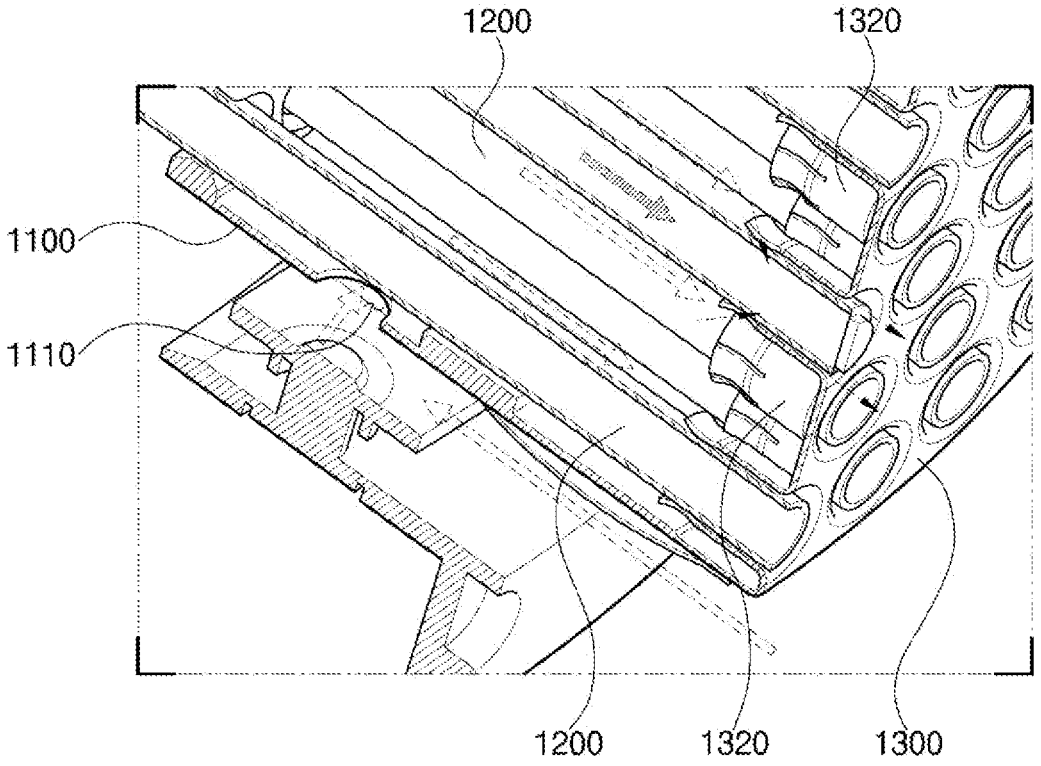
FIG. 5 is a view illustrating a third embodiment of the nozzle assembly illustrated in FIG. 1.

Referring to FIG. 5 and FIG. 6, when the injection nozzle 1200 has a circular tube structure, the guide portion 1320 may be concentric with the injection nozzle 1200. The guide portion 1320 may have a structure in which an inner diameter of the guide portion 1320 is larger than an outer diameter of the injection nozzle 1200.

At this time, a structure of the guide portion 1320 can be implemented in which one region inside the guide portion 1320, i.e., the contact region, protrudes inward so that the contact region is in contact with the injection nozzle 1200. At this time, the plurality of cooling air outlet holes 1310 may be formed along the longitudinal direction of the guide portion 1320. As an embodiment, the cooling air outlet holes 1310 may have elongated shapes, and may be disposed to be spaced apart from each other in a circumferential direction.

The contact region of the guide portion 1320 may have a structure that protrudes radially inward when viewed from the outside of the guide portion 1320, and it is preferable that the cooling air outlet hole 1310 is longer than the region that protrudes inward. In other words, the contact region of the guide portion 1320 may be convexly curved toward the radially inward direction such that the innermost point of the contact region of the guide portion 1320 can meet and support the injection nozzle 1200. In the convexly curved contact region, the inner diameter of the contact region, from its upstream end to it downstream end, may decrease and then increase. Specifically, when the guide portion 1320 is assembled with the injection nozzle 1200, the inner diameter of the contact region may decrease from the upstream end of the contact region to the innermost point and increase from the innermost point to the downstream end of the contact region.

Such a cooling air outlet hole 1310 is formed in a shape of slit along a longitudinal direction of the injection nozzle 1200, and may provide elasticity to the end portion of the guide portion 1320. In addition, the guide portion 1320 may be spaced apart from the injection nozzle 1200 forming a space therebetween and the cooling air outlet hole 1310 is in communication with a region, such that the cooling air introduced through the cooling air inlet hole 1110 may flow in the region toward the combustion.

As such, the cooling air outlet hole 1310 may provide elasticity to the guide portion 1320, and also functions as a flow path of cooling air.

When the injection nozzle 1200 is inserted into the guide portion 1320, the plurality of cooling air outlet holes 1310 formed in the end portion of the guide portion 1320 induce elastic deformation at the end portion of the guide portion 1320 while the injection nozzle 1200 is inserted into the guide portion 1320. Accordingly, the assembly of the injection nozzle 1200 may be easily performed, and one region of the guide portion 1320 where the cooling air outlet hole 1310 is formed is in contact with the injection nozzle 1200 and supports the injection nozzle 1200 when the assembly is completed. In addition, cooling air introduced through the cooling air inlet hole 1110 is introduced into a space where the guide portion 1320 and the injection nozzle 1200 are separated along the cooling air outlet hole 1310, so that the end portion of the injection nozzle 1200 may be cooled.

As described above, the embodiment of the present disclosure has been described in detail with reference to the accompanying drawings.

Although the embodiments of the present disclosure have been disclosed for illustrative purposes, those skilled in the art will appreciate that various modifications, additions and substitutions are possible, without departing from the scope and spirit of the present disclosure. Also, it is noted that any one feature of an embodiment of the present disclosure described in the specification may be applied to another embodiment of the present disclosure. As described above, the embodiments and the accompanying drawings disclosed in the present disclosure are provided for describing the present disclosure and are not intended to limit the technical ideas of the present disclosure. The technical ideas of the present disclosure are not limited to the embodiments and the drawings. The scope of the present disclosure should be construed as being covered by the scope of the appended claims, and all technical ideas falling within the scope of the claims should be construed as being included in the scope of the present disclosure.

The invention claimed is:

1. A nozzle assembly configured to discharge fuel and compressed air into a combustion chamber of a combustor of a gas turbine, the nozzle assembly comprising:

a nozzle body;

a plurality of injection nozzles provided inside the nozzle body and disposed to be spaced apart from each other, the plurality of injection nozzles having inner portions through which an air-fuel mixture of the fuel and a first portion of the compressed air flows; and a side wall which is connected to a first side of the nozzle body, wherein a cooling air inlet hole into which a second portion of the compressed air is introduced, as a cooling air, into a space where the plurality of injection nozzles is disposed is formed in the nozzle body, and a cooling air outlet hole through which the cooling air introduced from the cooling air inlet hole is discharged is formed in one region of the side wall, wherein one side surface of the side wall meets an inside space of the nozzle body and an opposite side surface of the side wall meets the combustion chamber, wherein the side wall is provided with a guide portion that protrudes toward the inside space of the nozzle body from the side wall meeting the combustion chamber, the guide portion including a contact region being in contact with the plurality of injection nozzles, wherein the contact region is in a curved shape such that a diameter of the contact region decreases and then increases from an upstream end to a downstream end based on a flow direction of the air-fuel mixture in the plurality of injection nozzles, wherein a most downstream end of each of the plurality of infection nozzles is disposed at the side wall such that the plurality of injection nozzles do not protrude downstream than the side wall, wherein a plane at which the most downstream end of each of the plurality of injection nozzles is disposed is aligned with the side wall through which the cooling air is discharged to the combustion chamber.

2. The nozzle assembly of claim 1, wherein first sides of the plurality of injection nozzles are inserted into the guide portion.

3. The nozzle assembly of claim 2, wherein the guide portion is disposed such that the guide portion has a region that is spaced apart from outer surfaces of the plurality of injection nozzles.

4. The nozzle assembly of claim 3, wherein the cooling air outlet hole is formed in one region of the guide portion.

5. The nozzle assembly of claim 2, wherein the contact region of the guide portion is configured to apply an elastic force in a radially inward direction of each of the plurality of injection nozzles.

6. The nozzle assembly of claim 5, further comprising at least one supplementary cooling air outlet holes, and the at least one supplementary cooling air outlet holes is formed in the contact region of the guide portion along a longitudinal direction of the guide portion.

7. The nozzle assembly of claim 6, wherein a cross-section of the guide portion has a shape that is same as a cross-section of the plurality of injection nozzles.

8. The nozzle assembly of claim 1, wherein the side wall is formed at the downstream end of plurality of injection nozzles.

9. The nozzle assembly of claim 8, wherein the side wall is located such that the side wall defines at least partially an upstream end of the combustion chamber.

10. A combustor configured to mix compressed air supplied from a compressor of a gas turbine with fuel and to combust the compressed air and the fuel in a combustion chamber, the combustor being configured to supply a generated combustion gas to a turbine of the gas turbine, and the combustor comprising:

a nozzle casing;

a liner connected to an end portion of the nozzle casing, the liner having an inner portion provided with the combustion chamber;

a transition piece connected to an end portion of the liner, the transition piece being configured to supply the combustion gas generated from the combustion chamber to the turbine; and a nozzle assembly mounted inside the nozzle casing and configured to discharge the fuel and the compressed air into the combustion chamber, wherein the nozzle assembly comprises:

a nozzle body;

a plurality of injection nozzles provided inside the nozzle body and disposed to be spaced apart from each other, the plurality of injection nozzles having inner portions through which an air-fuel mixture of the fuel and a first portion of the compressed air flows; and a side wall which is connected to a first side of the nozzle body, wherein a cooling air inlet hole into which a second portion of the compressed air is introduced, as a cooling air, into a space where the plurality of injection nozzles is disposed is formed in the nozzle body, and a cooling air outlet hole through which the cooling air introduced from the cooling air inlet hole is discharged is formed in one region of the side wall, wherein one side surface of the side wall meets an inside space of the nozzle body and an opposite side surface of the side wall meets the combustion chamber, wherein the side wall is provided with a guide portion that protrudes toward the inside space of the nozzle body from the side wall meeting the combustion chamber, the guide portion including a contact region being in contact with the plurality of injection nozzles, wherein the contact region is in a curved shape such that a diameter of the contact region decreases and then increases from an upstream end to the downstream end based on a flow direction of the air-fuel mixture in the plurality of injection nozzles, wherein a most downstream end of each of the plurality of injection nozzles is disposed at the side wall such that the plurality of injection nozzles do not protrude downstream than the side wall, wherein a plane at which the most downstream end of each of the plurality of injection nozzles is disposed is aligned with the side wall through which the cooling air is discharged to the combustion chamber.

11. The combustor of claim 10, wherein first sides of the plurality of injection nozzles are inserted into the guide portion.

12. The combustor of claim 11, wherein the guide portion is disposed such that the guide portion has a region that is spaced apart from outer surfaces of the plurality of injection nozzles.

13. The combustor of claim 12, wherein the cooling air outlet hole is formed in one region of the guide portion.

14. The combustor of claim 13, further comprising at least one supplementary cooling air outlet holes, and the at least one supplementary cooling air outlet holes is formed in the contact region of the guide portion along a longitudinal direction of the guide portion.

15. A gas turbine comprising:

a compressor configured to compress air introduced from outside;

a combustor configured to mix compressed air supplied from the compressor with fuel and to combust the compressed air and the fuel in a combustion chamber; and a turbine configured to generate power for generating electric power by passing combustion gas supplied from the combustor to an inner portion of the turbine, wherein the combustor comprises:

a nozzle casing;

a liner connected to an end portion of the nozzle casing, the liner having an inner portion provided with the combustion chamber;

a transition piece connected to an end portion of the liner, the transition piece being configured to supply the combustion gas generated from the combustion chamber to the turbine; and a nozzle assembly mounted inside the nozzle casing and configured to discharge the fuel and the compressed air into the combustion chamber, wherein the nozzle assembly comprises:

a nozzle body;

a plurality of injection nozzles provided inside the nozzle body and disposed to be spaced apart from each other, the plurality of injection nozzles having inner portions through which an air-fuel mixture of the fuel and a first portion of the compressed air flows; and a side wall which is connected to a first side of the nozzle body, wherein a cooling air inlet hole into which a second portion of the compressed air is introduced, as a cooling air, into a space where the plurality of injection nozzles is disposed is formed in the nozzle body, and a cooling air outlet hole through which the cooling air introduced from the cooling air inlet hole is discharged is formed in one region of the side wall, wherein one side surface of the side wall meets an inside space of the nozzle body and an opposite side surface of the side wall meets the combustion chamber, wherein the side wall is provided with a guide portion that protrudes toward the inside space of the nozzle body from the side wall meeting the combustion chamber, the guide portion including a contact region being in contact with the plurality of injection nozzles, wherein the contact region is in a curved shape such that a diameter of the contact region decreases and then increases from an upstream end to the downstream end based on a flow direction of the air-fuel mixture in the plurality of injection nozzles, wherein a most downstream end of each of the plurality of infection nozzles is disposed at the side wall such that the plurality of injection nozzles do not protrude downstream than the side wall, wherein a plane at which the most downstream end of each of the plurality of injection nozzles is disposed is aligned with the side wall through which the cooling air is discharged to the combustion chamber.

16. The gas turbine of claim 15, wherein first sides of the plurality of injection nozzles are inserted into the guide portion.

17. The gas turbine of claim 16, wherein the guide portion is disposed such that the guide portion has a region that is spaced apart from outer surfaces of the plurality of injection nozzles.

18. The gas turbine of claim 17, wherein the cooling air outlet hole is formed in one region of the guide portion.

19. The gas turbine of claim 18, further comprising at least one supplementary cooling air outlet holes, and the at least one supplementary cooling air outlet holes is formed in the contact region of the guide portion along a longitudinal direction of the guide portion.

* * * * *